US008474158B2

(12) United States Patent
Samuels et al.

(10) Patent No.: US 8,474,158 B2
(45) Date of Patent: Jul. 2, 2013

(54) MOLDED SNOWSHOE WITH COMPOUND DECK

(75) Inventors: Rudy Lucas Samuels, Mill Valley, CA (US); Chris Barchet, Seattle, WA (US); Dodd Grande, Seattle, WA (US); Rachel Lin, Seattle, WA (US); Mark S. Williams, Burien, WA (US); Scott Youmans, Seattle, WA (US)

(73) Assignee: K-2 Corporation, Seattle, WA (US)

( * ) Notice: Subject to any disclaimer, the term of this patent is extended or adjusted under 35 U.S.C. 154(b) by 643 days.

(21) Appl. No.: 12/657,610

(22) Filed: Jan. 21, 2010

(65) Prior Publication Data

US 2011/0173844 A1 Jul. 21, 2011

(51) Int. Cl.
*A43B 5/04* (2006.01)

(52) U.S. Cl.
USPC ..... 36/123

(58) Field of Classification Search
USPC ..... 36/122–125
See application file for complete search history.

(56) References Cited

U.S. PATENT DOCUMENTS 4,348,823 A * 9/1982 Knapp et al. ..... 36/123
5,469,643 A 11/1995 Forrest
5,517,773 A 5/1996 Forrest et al.
5,531,035 A 7/1996 Forrest
5,542,197 A * 8/1996 Vincent ..... 36/122
5,718,068 A * 2/1998 Sawyer et al. ..... 36/122
5,921,007 A 7/1999 Forrest et al.
6,006,453 A 12/1999 Klebahn et al.
6,195,919 B1 3/2001 Forrest et al.
6,226,899 B1 5/2001 Klebahn et al.
6,898,874 B2 5/2005 Emerson et al.
7,984,572 B2 * 7/2011 Gallay ..... 36/122
2009/0007456 A1 * 1/2009 Garneau ..... 36/124

* cited by examiner

*Primary Examiner* — Ted Kavanaugh
(74) *Attorney, Agent, or Firm* — Thomas M. Freiburger

(57) ABSTRACT

A molded or plastic composite snowshoe is formed of two assembled sections, in a way that imparts flexibility to the snowshoe, allowing some degree of torsional twisting or warping flexibility so that the snowshoe adapts to uneven terrain. In a principal embodiment the molded snowshoe is divided into forward and aft sections along a line slightly behind the nose area and near the pivot axis in the case of a pitch-pivoting binding. Joints between sections are in narrow rims at left and right, at opposed sides of a large central opening for the crampon/binding and boot. The joints are designed to securely hold the forward and aft molded sections together but to allow a degree of torsion between them when needed. Steel structural traction rails extend across the joints but are constructed and secured to the snowshoe sections in a manner that preserves the desired flexibility.

8 Claims, 9 Drawing Sheets

MOLDED SNOWSHOE WITH COMPOUND DECK

BACKGROUND OF THE INVENTION

This invention concerns snowshoes, particularly snowshoes of molded plastic or composite material, and the invention encompasses a molded snowshoe with improved ability to adapt to uneven terrain.

Traction and stability on a varied terrain are valuable attributes for a snowshoe. One way to allow enhanced traction and stability is to provide a snowshoe structure which can adapt to various surface contours to effect better contact with the surface, and thus enhanced traction and stability. This invention provides a structure with improved ability to adapt to and make contact with the snow or ice surface on which the snowshoe is used.

Typical snowshoes provide flotation, traction and stability by the incorporation of flotation means (primarily a deck), traction means (cleats or rails), and a means to attach the user's foot to a relatively rigid structure (a boot binding).

The traditional frame based snowshoe has a peripheral framed structure that is essentially rigid. This is required to suspend and support the traditional flotation surfaces that consist of flexible members such as rawhide strips, coated fabrics or thin plastic sheets. Traction elements are attached to the underside of this construction for improved traction on ice and snow surfaces. A binding of some type is attached to the structure to receive the user's foot. The traditional framed snowshoe construction thus teaches the need for a rigid frame surrounding the periphery of the snowshoe, and a flexible decking material suspended within the frame. The flexible decking is inherently too flexible to bear the flotation loads of the snowshoe without the support of the peripheral frame.

It can be advantageous with such a construction to allow the traction elements attached to the snowshoe structure to conform to the contours of the snow and ice surface by providing some level of relative flexibility or suspension from the generally rigid structure of the snowshoe. The flexible decking snowshoe suspends some traction elements on the deck, and suspends the binding (with toe cleat) somewhat, and thus adapts to some extent to the terrain. Other prior approaches using this concept include the use of various suspension systems such as in K2 Snowshoes U.S. Pat. No. 6,898,874, which provides adaptation to side terrain. There have been other approaches for suspending the snowshoe binding and the traction elements attached to the underside of the snowshoe bindings, which allow some degree of relative motion or flexibility between the overall snowshoe structure and the binding with its attached traction means.

More recently, constructions of snowshoes have been developed that consist of flotation surfaces formed of materials such as injection molded plastic, of a thickness and stiffness such as not to require peripheral frames to help resist and support the flotation loads associated with snowshoeing. One such prior art example can be found in the MSR Denali model snowshoe made of a molded one piece surface comprising the flotation surface of the snowshoe. Additional structure is provided in the form of two steel rails running longitudinally along the lower side of the molded decking surface, which also serve as traction elements. This prior art teaches the importance of structural rigidity through the combination of the structure of the longitudinal metal rails, along with structural channels molded into the decking structure of the snowshoe. See, for example, MSR U.S. Pat. Nos. 5,469,643, 5,517,773 and 5,921,007.

In the described MSR snowshoe, the binding of the snowshoe was attached to the longitudinal traction rails in a pivoting fashion. A certain degree of structural flexibility of the overall structure is obtained by this arrangement. However, the structural rigidity of this construction is also somewhat limiting on the degree to which the structure can conform to the underlying contours. Further, the need to use one material for the entire deck surface for such constructions can be a limitation in the selection of materials to meet the various requirements of the snowshoe structure.

The above are examples of ways in which the prior art has achieved the required flotation and structure required of a snowshoe combined with contact and traction with the underlying terrain surface.

The prior art also discloses a compound deck snowshoe, with an additional piece of deck structure or "tail extender" that can be added or taken off the snowshoe body by the user, as a means to alter the degree of flotation of the snowshoe, as in U.S. Pat. Nos. 5,517,773 and 6,195,919; see also U.S. Pat. Nos. 6,006,453 and 6,226,899. While such prior art does disclose a deck comprised of two or more pieces, it does not teach any method for substantially affecting the overall structural flexibility of the snowshoe structure, for adaptation to terrain. Further, the loads that can be imparted into the second decking section in U.S. Pat. No. 6,195,919 are limited by the absence of any substantial structural member spanning the mating region.

There is a need for a molded or composite snowshoe that has a deck rigidity sufficient for the needed flotation while also affording a torsional (warping) flexibility that allows the traction elements or cleats on the snowshoe bottom to contact uneven terrain.

SUMMARY OF THE INVENTION

A molded snowshoe construction in accordance with the invention includes a decking surface constructed of a material and of such thickness that support from a peripheral frame is not needed. A typical such snowshoe decking can be formed of molded plastic materials of approximately 3 mm thickness, or molded fiber reinforced composite of somewhat lesser thickness.

The molded snowshoe of the invention is constructed in a way so as to allow the cleats or traction elements of the snowshoe to contact the underlying terrain surface contours even when the surface is uneven, greatly improving traction. This is achieved by improving the structural flexibility of the snowshoe by forming the deck of the molded snowshoe in two or more separate pieces connected together. These pieces are molded of materials and of a thickness such they are able to bear the flotation loads required by the snowshoe. Structural integrity of the snowshoe is obtained by the use of elongated structural members, such as metal rails on the snowshoe bottom, which extend continuously through a joint between the deck segments, but the design affords torsional flexibility of the snowshoe.

Preferably the multi-section deck structure is formed with a fore deck section and an aft deck section. The joint preferably is at two locations, both being narrow outer rims at left and right, adjacent to a large central opening in which the snowshoe binding is suspended. The sections are joined in these narrow regions in a way that allows for torsional flexibility of the snowshoe, improving flexibility to accommodate deformation so that the cleats or traction elements at the bottom of the snowshoe can better adapt to uneven terrain, to improve traction. The positioning of the joints is designed to allow conforming deformation in a way that will optimally adapt to terrain.

In a preferred embodiment two main longitudinal structural elements span the region where the two deck sections meet. These structural elements advantageously comprise metal rails extending through most of the length of the snowshoe and serving also as traction elements on the underside of the snowshoe. Further, the boot binding can be supported by the metal rails, which applies the load from the user directly to these elongated metal structural elements that also preferably serve as traction rails.

The compound molded deck structure of the invention has the further advantage that the fore deck and aft deck sections can be formed of materials with different properties, such that each section, and portions within each section (via thickness variation), can be tailored to achieve a degree of local flexibility which serves the objective of the overall structure.

Accordingly, it is among the objects of this invention to achieve in a molded snowshoe a better ability to adapt to uneven terrain and to make good traction with the terrain, while still maintaining the strength, needed flotation and structural integrity of a molded snowshoe. These and other objects, advantages and features of the invention will be apparent from the following description of a preferred embodiment, considered along with the accompanying drawings.

DESCRIPTION OF PREFERRED EMBODIMENTS

Figure 1:
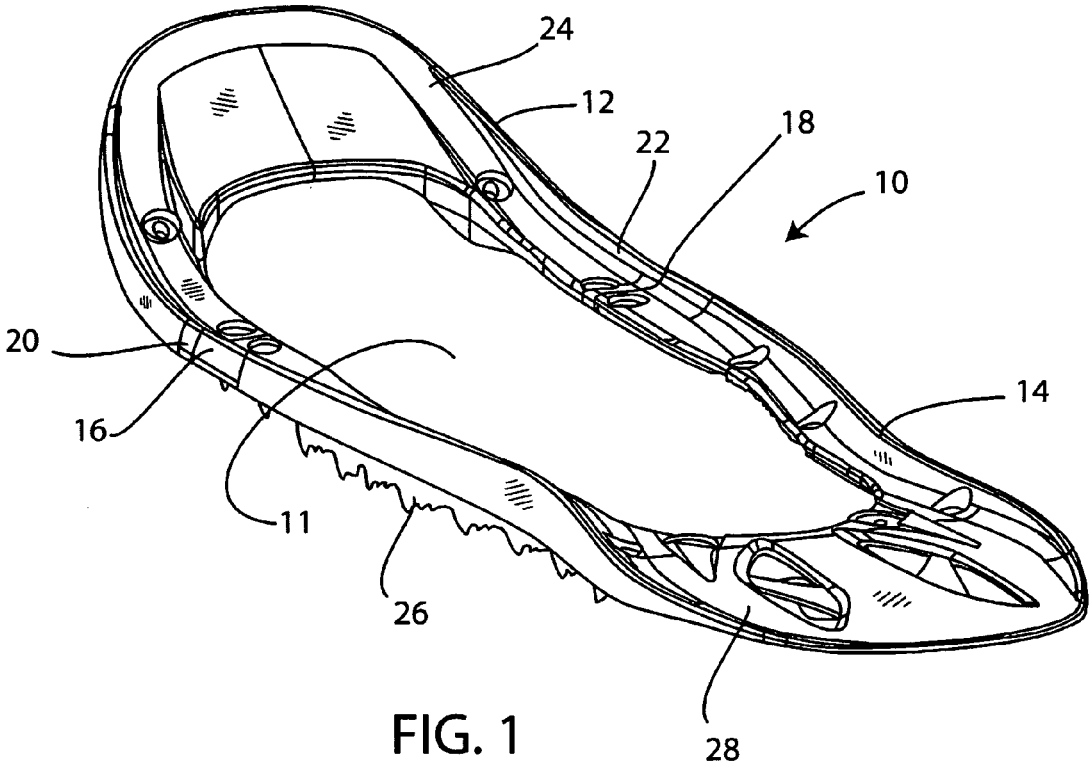
FIG. 1 is a perspective view showing a molded snowshoe body according to the invention, shown without binding.

FIG. 1 shows a snowshoe body 10 of the invention, in one preferred form. The snowshoe body 10 is molded of plastic material, preferably injection molded of an uncrosslinked polymer such as polypropylene, nylon or urethane. The plastic may be without reinforcing fibers, or it can be reinforced if desired. A compression molded thermoset resin reinforced with fibers such as glass could be used.

Figure 2:
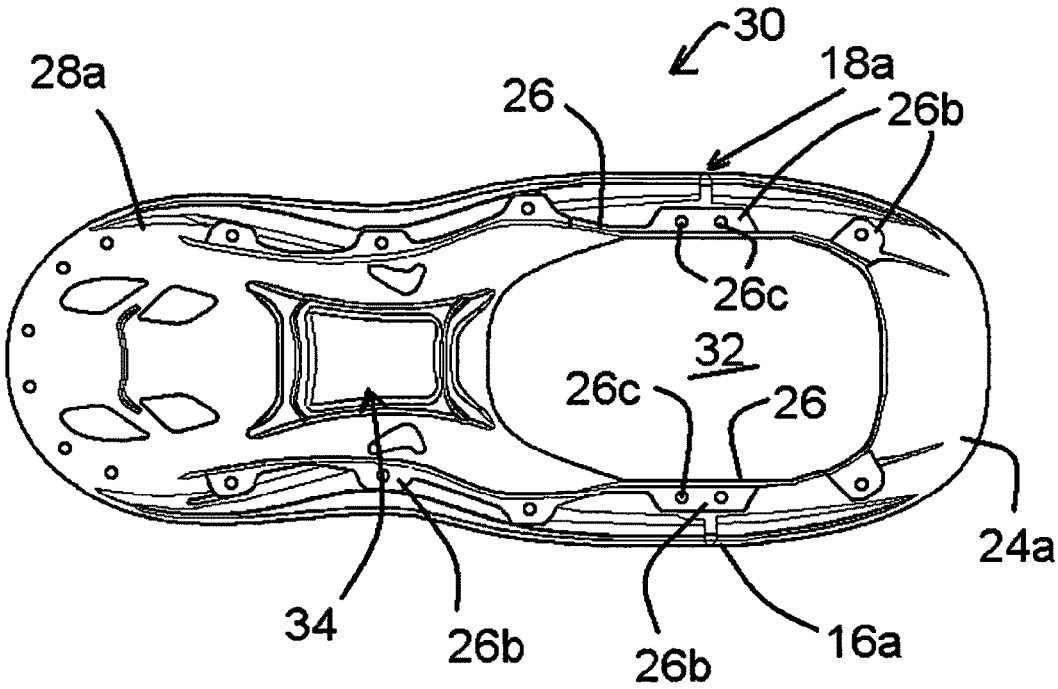
FIG. 2 is a bottom view of a somewhat modified snowshoe body.

In this form of the invention the snowshoe body has a large central opening 11 for a crampon/boot binding assembly, in this case a boot binding that includes a heel support area (as opposed to snowshoes that allow the boot heel to rest on a rear deck area, such as in FIG. 2). As seen in the drawing, the snowshoe body has a fore section or fore deck 12 and an aft section or aft deck 14, these being secured together at a joint comprised of left and right junctures or joints 16 and 18 in narrow outer rim regions 20 and 22 of the snowshoe body structure. At each joint connection 16, 18 the width of the narrow neck or rim may be about 1½" (or between about 1" and 2"), or each rim may have a width in the range of about 15% to 20% of the overall width of the snowshoe. A typical overall width of the snowshoe (at widest point) is about 8"; typical width of the opening is about 5¼"; typical overall snowshoe length is about 24".

As the drawings indicate, the joint formed by the connections 16 and 18 preferably is behind a snowshoe nose portion 24 and generally in a region where a snowshoe binding (not shown) will be supported for pitch pivoting movement.

FIG. 1 also shows a traction rail 26 included on each side, preferably extending from the nose back to a snowshoe tail 28. These rails 26 act as structural members as well, adding flexure strength, and are further discussed below. They can support the binding, such as by supporting a pivot shaft.

FIG. 2 shows a different snowshoe body 30, with a smaller central opening 32 for a binding, not shown. In this design the user's boot will rest on the snowshoe deck, in a region generally indicated at 34. This view shows the snowshoe bottom, including the metal traction rails 26 at each side. The rails may be sinuous in shape to accommodate the shape of the snowshoe, or they could be linear, based on snowshoe configuration. The sinuous shape helps in achieving traction. It is important that these metal rails extend through the joint connections 16*a* and 18*a* for strength and integrity of the snowshoe. They act as spars that take the load that bears on the snowshoe. The nose of this snowshoe is indicated at 24*a*, and the tail at 28*a*.

Figure 3:
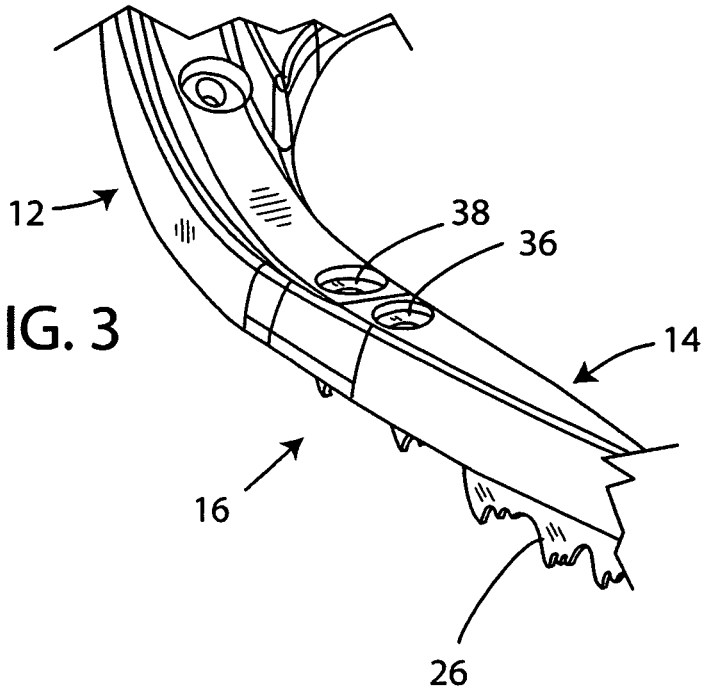
FIG. 3 is a perspective detail view showing one of a plurality of joints in the snowshoe body, between sections.
Figure 4:
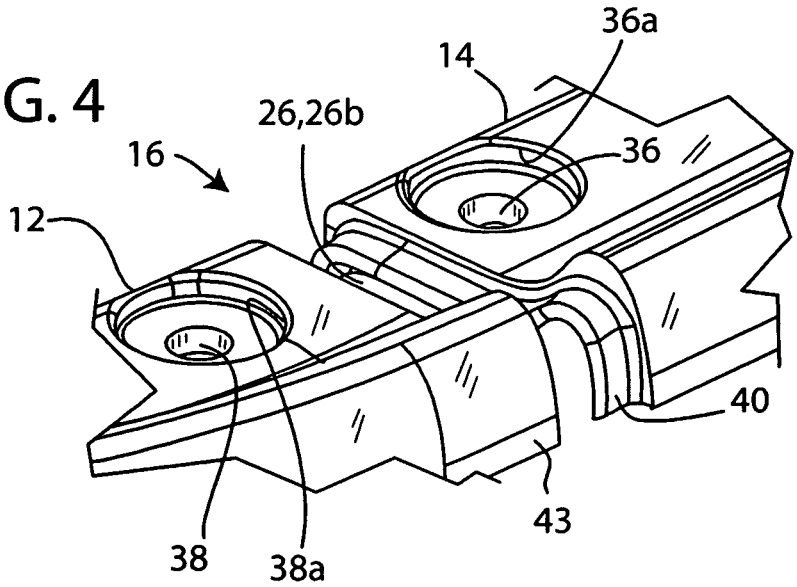
FIGS. 4 and 4A are enlarged perspective views again showing a portion of the snowshoe body and a joint between the sections, partially separated in these views. The two views are from different angles.

FIGS. 3, 4, 4A and 5 show one preferred structure of a joint as at 16 or 18 in FIG. 1. All are viewed from the outside edge of the snowshoe. FIG. 3 shows the joint 16 as secured together, revealing the metal traction rail 26 extending from the bottom of the snowshoe body. FIG. 4 shows the joint 16 opened prior to full assembly, with the fore deck section 12 separated and spaced slightly away from the aft deck section 14. The outside of the snowshoe is visible nearest in FIG. 4. As illustrated, the structural rail 26, which is generally a vertically-disposed member, with traction teeth such as shown in FIG. 1, includes generally horizontal connecting flanges such as seen at 26*b* in the drawing. These are also visible in the embodiment in FIG. 2, shown with securement holes 26*c*. These connection holes on the rail are not seen in FIG. 4, but mating fastener holes 36 and 38 are seen in the aft deck section 14 and fore deck section 12 in this narrow rim region where the joint 16 occurs. The fastener openings 36, 38 are shown with countersink recesses 36*a* and 38*a* for the heads of rivets, machine bolts or other fasteners. See also FIGS. 4A, 5 and 6.

Figure 4A:
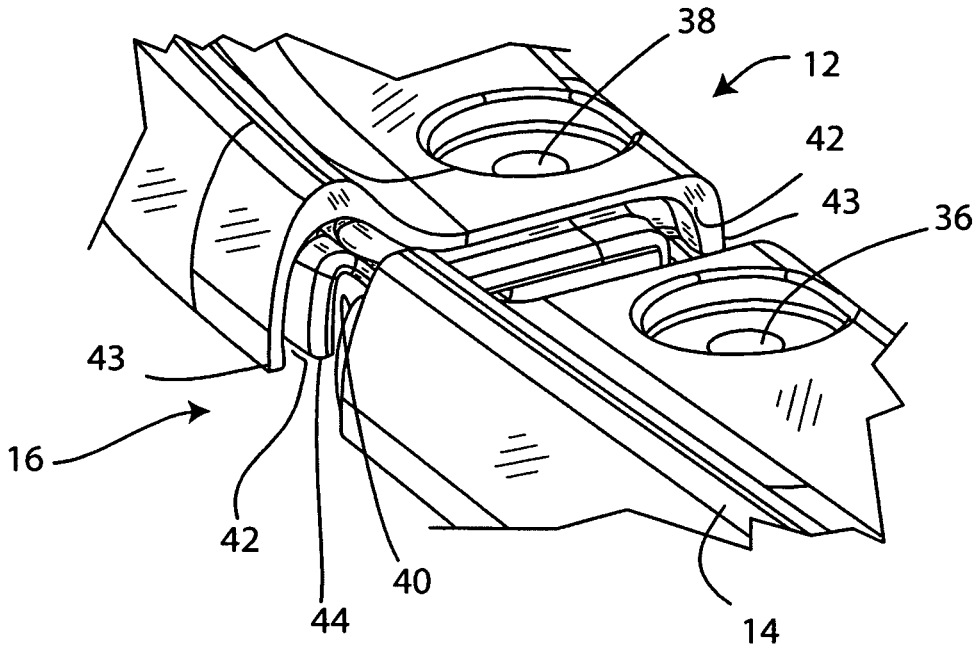
Figure 5:
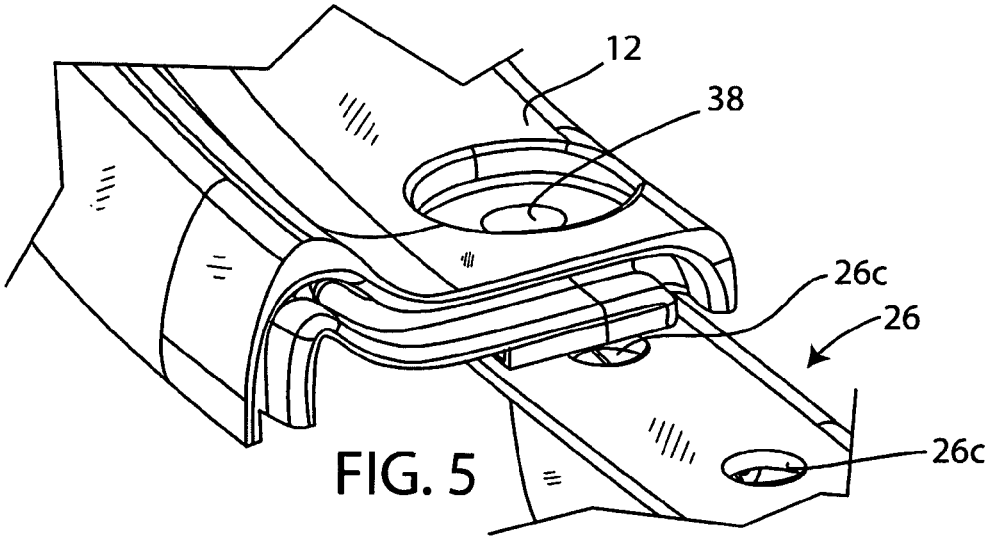
FIG. 5 is a perspective detail view showing the same region of the snowshoe, revealing a metal with reinforcing rail, and with one of the snowshoe sections removed.

FIGS. 4, 4A and 5 also show that the narrow connecting portions of the fore deck section 12 and the aft deck section 14 are formed with an overlapping joint for a secure connection. The overlapping joint construction includes an inner flange or ridge 40 that extends forward from the aft section, at a laterally inward, receded position as shown. This member, which is shaped and curved generally in accordance with the outer shape of the narrow region of the two sections 14 and 12, fits into a complementarily shaped socket 42 formed inward of an outer edge flange 43; the socket 42 extends around this region of the fore section 12, as illustrated particularly in FIG. 4A, to form a tight joint. As seen in FIG. 4A, this joint connection can include a further, inner connector flange 44 on the fore section 12, to further overlap in the joint, just inside the flange 40 of the aft section 14. Thus, the connected joint 16 is composed of three overlapping layers, a layer or ridge 40 protruding from the aft deck section 14 extending between two layers 43 and 44 in the fore deck section 12. This produces a high integrity joint, but one which can allow some relative twisting motion at the joint.

Figure 6:
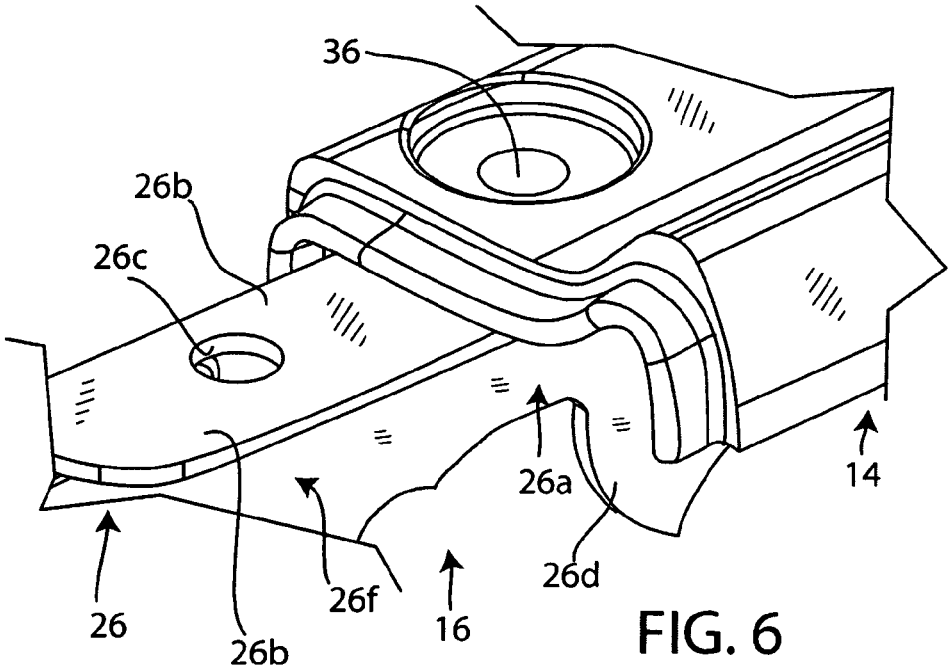
FIG. 6 is another perspective view, showing the same structure from an opposite side.

FIGS. 5 and 6 show fastener holes 26*c* in the metal rail 26, for receiving fasteners through the fastener holes 38 in the fore section 12 (FIG. 5) and 36 in the aft deck section 14 (FIG. 6). Rivets or machine bolts (not shown) pass through the fastener holes 36, 38 and through the rail holes 26*c* to secure the two deck sections to the rail 26 at the joint. The aft deck section 14 is shown in FIG. 6, along with the metal rail 26, again viewed from the outside edge of the snowshoe. The traction edge 26*d* extends down at the inner side of its narrow rim at the joint, that is, adjacent to the central opening 11 in the snowshoe. Again, a fastener, not shown, extends through the fastener opening 36 and through the fastener hole 26*c* in the rail, the latter being below the hole 36 bit not seen in FIG. 6.

Figure 7:
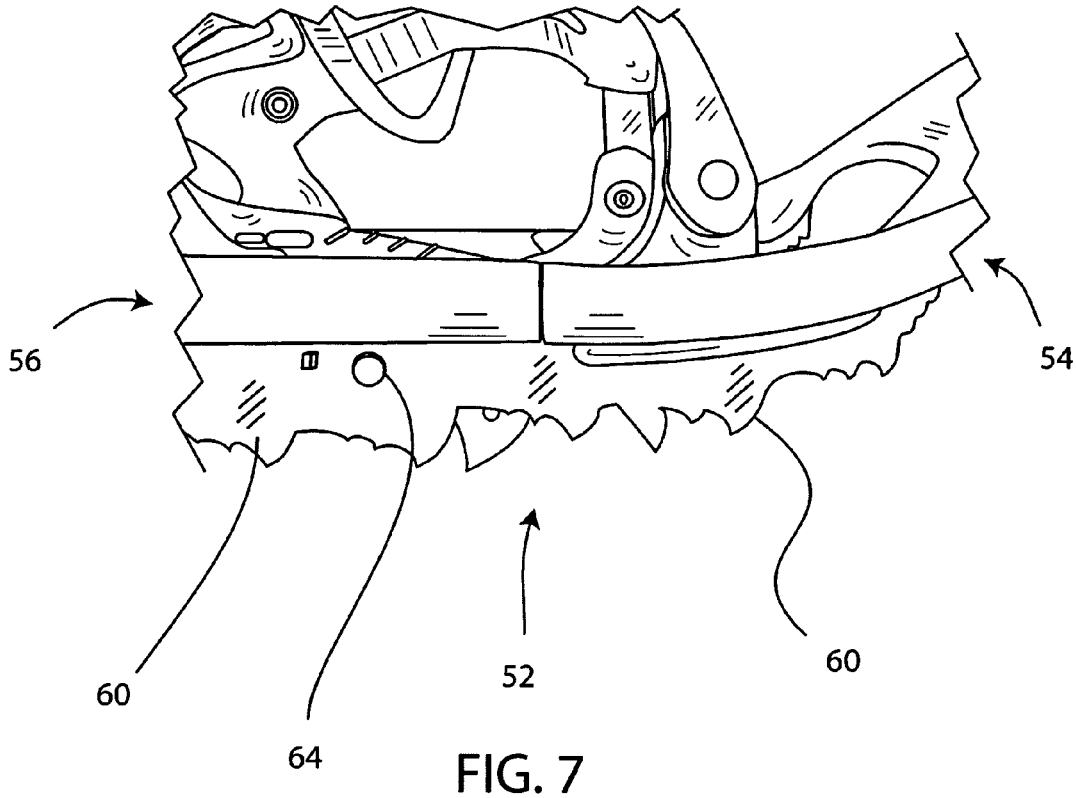
FIG. 7 is a side elevation view showing another form of joint between snowshoe body sections and rail sections.
Figure 8:
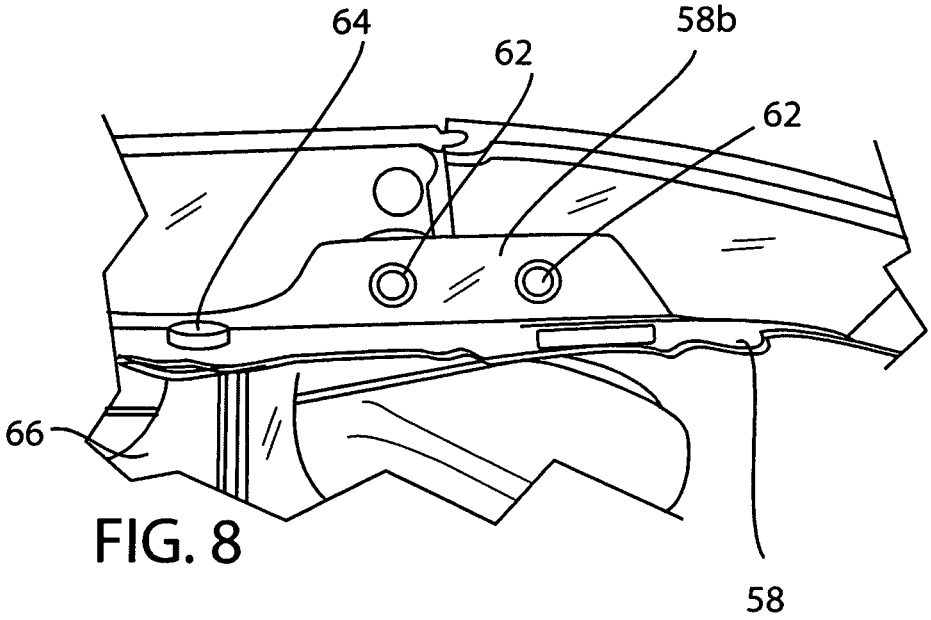
FIG. 8 is a bottom view showing the construction of FIG. 7.

FIGS. 7 and 8 show a side view of a snowshoe 50 having a joint 52 between a fore snowshoe body section 54 and an aft snowshoe body section 56. The joint 52 can be made generally as described above, with both fore and aft sections 54 and 56 being bolted or riveted to a metal structural rail 58 that also serves as a traction element, as shown, with teeth 60 extending downward toward terrain. FIG. 8 (bottom plan) shows that the metal rail/traction element 58 has several horizontal flanges 58*b* for fasteners 62 to secure the rail member to the fore and aft molded plastic sections. FIGS. 7 and 8 show a pin connection 64 that connects a footbed/crampon mounting 66 to the metal structural rail 58 to allow pivoting of the footbed/crampon assembly within a central opening of the snowshoe, such as the opening 11 or 32 shown in FIG. 1 or 2.

Figure 9:
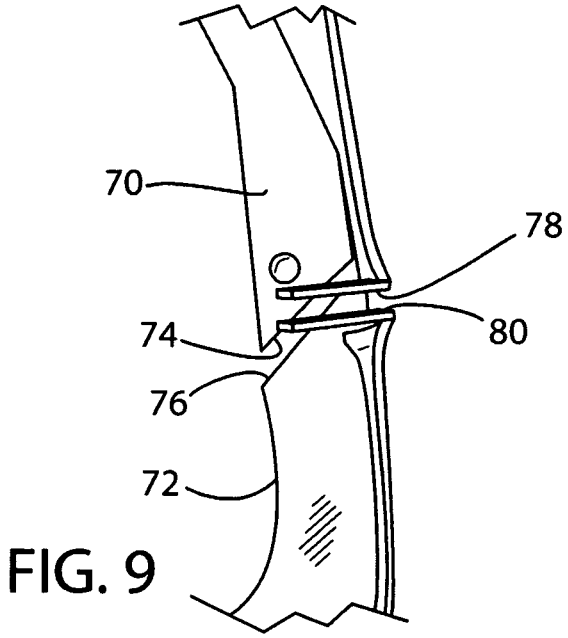
FIG. 9 is a perspective view showing a different embodiment of a joint between snowshoe sections, according to the invention.
Figure 10:
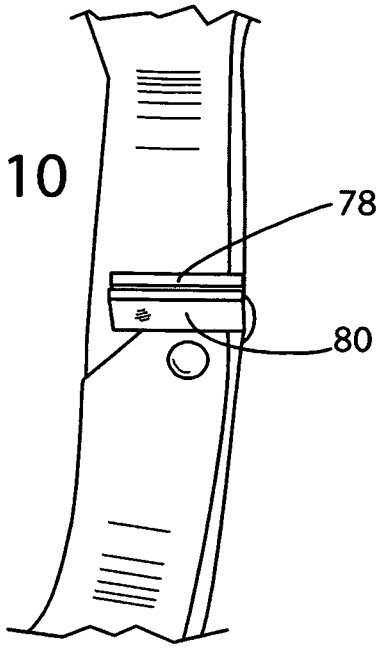
FIG. 10 is another view of the joint construction shown in FIG. 9.

FIGS. 9 and 10 show another form of rail joint wherein the joint is made flexible through an angled connection. In this joint the two snowshoe sections 70 and 72 joined via obliquely angled horizontal deck joint edges 74 and 76, as shown in both FIGS. 9 and 10, and via abutting vertical plates 78 and 80 that are integrally molded with the sections. In FIG. 10 the vertical plates 78, 80 are shown abutted in contact, and they can be secured together by a fastener through those abutted plates (not shown).

Figure 11:
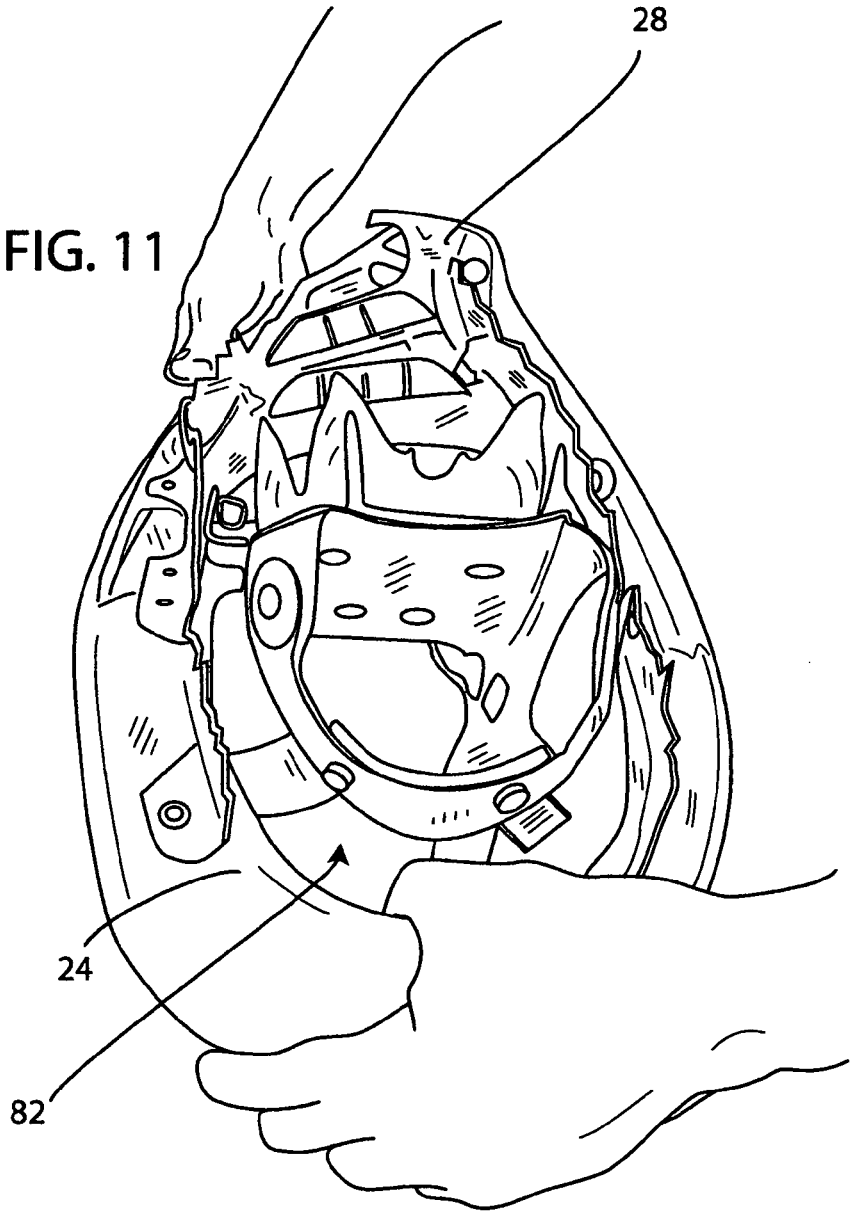
FIG. 11 is a perspective view showing a snowshoe of the invention exhibiting torsional flexibility and deflection.

FIG. 11 shows a snowshoe of the invention being subjected to torsion by a person applying a twisting moment, such that the forward end or nose 24 is twisted relative to the aft end 28. The crampon/binding assembly 82 is seen in this view, pivotally connected to the traction rail at each side. In a preferred embodiment, a torsional force applied to the snowshoe by uneven terrain and from a user of average weight (150 to 170 pounds) will create an angular deflection of about 15° to 20° or more in the snowshoe, between forward and aft ends. As explained above, this is achieved through the joints that connect fore and aft sections, as well as by the material and thickness of material used. The structural traction rails allow this torsional flexibility while acting as load-bearing spars for flexure strength for the length of the snowshoe.

Figure 12:
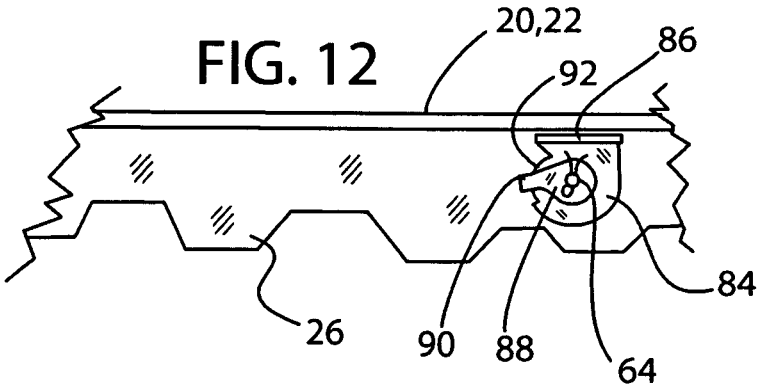
FIG. 12 is a detailed elevation view showing a pivoted connector of a crampon/binding assembly to a traction rail in the snowshoe.

FIG. 12 shows schematically a part of the snowshoe including a portion of the molded deck rim 20, 22 and a structural traction rail 26, secured to the underside of the deck. The drawing shows a metal portion 84 of the crampon/binding assembly 82, where this crampon assembly is secured to the rail 26 via the pin connection 64. The metal portion 84 extends away from the rail 26, which is inward of the snowshoe (toward the viewer in FIG. 12), as indicated by the sectioned region 86. This drawing indicates one method for rotation-limiting the crampon/binding assembly. A tab 88, which is fixed to the rail (which can be an extension of a protruding end 90 of the tab into a hole in the rail), co-acts with the pivoting crampon/binding structure 84 to allow rotation only through an arc as defined by an arcuate cutout area 92 in the metal piece 84.

The joints 16, 18 provide for the torsional flexibility of the snowshoe in combination with the flexibility of the snowshoe molded deck sections themselves, a function of material and thickness and any reinforcing patterns molded into the deck. The two deck sections can be of different materials, not only for torsional flexibility or rigidity but to provide one section with higher strength or toughness requirements than the other. Properties can be tailored; colors can be different.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

We claim:

1. A molded snowshoe with terrain adaptation, comprising:

a molded snowshoe body in at least two sections, the snowshoe body having a large opening in a forward portion of the snowshoe body, and a crampon/boot binding assembly for a user's boot supported on the snowshoe body in said opening, the at least two sections including a forward section extending through a nose region of the snowshoe, and an aft section connected to the forward section, and the two sections being connected together at left and right narrow rims on either side of the large central opening of the snowshoe body, in a pair of joints that provide for torsional, warping flexibility of the snowshoe body between the forward and aft sections.

2. The molded snowshoe of claim 1, further including elongated metal traction rails secured to the bottom of the snowshoe body at left and right and extending across the joints in the left and right narrow rims.

3. The molded snowshoe of claim 2, wherein the crampon/boot binding assembly includes a pivot pin at each side, connecting the crampon/boot binding assembly at each side to the metal traction rail to provide for pitch pivoting of the crampon/boot binding assembly relative to the snowshoe body.

4. The molded snowshoe of claim 3, further including a rotation limiter at each side of the crampon/boot binding assembly, connected to the pin and positioned to limit rotation of the crampon/boot binding assembly relative to the traction rail and the snowshoe body.

5. The molded snowshoe of claim 2, wherein the molded snowshoe body sections are secured to horizontal flanges on the metal traction rails, through the length of the metal traction rails including adjacent to the joints.

6. The molded snowshoe of claim 2, wherein the elongated metal traction rails are sinuous in shape, curving laterally in the length of each rail to enhance forward traction.

7. The molded snowshoe of claim 1, wherein the large central opening has a length in the range of about 9" to 16".

8. The molded snowshoe of claim 1, including at each joint a socket connection between the narrow rim of the forward section and the narrow rim of the aft section, with a curved projecting flange or ridge of one of the sections extending into a similarly curved socket of the other section.

* * * * *